US005600107A

United States Patent [19]

Tsai

[11] Patent Number: 5,600,107

[45] Date of Patent: Feb. 4, 1997

[54] ELECTRIC SWITCH WITH DYNAMIC BRAKE CONTACT SHARED FOR MAKING AND BREAKING A POWER CIRCUIT

[75] Inventor: David Y. Tsai, Arab, Ala.

[73] Assignee: Eaton Corporation, Cleveland, Ohio

[21] Appl. No.: 508,009

[22] Filed: Jul. 27, 1995

[51] Int. Cl.[6] ..... H01H 9/00; H01H 5/00

[52] U.S. Cl. ..... 200/1 R; 200/6 R; 200/450; 310/68 A

[58] Field of Search ..... 318/245; 307/125, 307/126; 200/1 R, 5 R, 6 R, 405–423, 431–438, 447–450, 453–461; 310/68 A

[56] References Cited

U.S. PATENT DOCUMENTS

| | | | |
|---|---|---|---|
| 3,548,276 | 12/1970 | Gross | 318/245 |
| 3,766,348 | 10/1973 | Johnson | 307/126 |
| 3,869,590 | 3/1974 | Hults | 200/435 |
| 4,095,072 | 6/1978 | Piber | 307/126 |
| 4,149,053 | 4/1979 | Long | 200/DIG. 42 |
| 4,523,115 | 6/1985 | Cuneo | 310/68 A X |
| 4,864,083 | 9/1989 | Bittel | 200/1 V |
| 4,968,922 | 11/1990 | Bittel | 200/5 R X |

*Primary Examiner*—J. R. Scott
*Attorney, Agent, or Firm*—L. G. Vande Zande

[57] ABSTRACT

A double pole single throw electric switch has normally closed contacts of one pole connected in a dynamic braking circuit with a motor load and normally open contacts connecting the motor to a source of power. A partial movable contact conductively connected to movable contacts of the normally open contacts is disposed in normally open position relative to one contact of the normally closed contacts to provide a parallel path through the switch for making and breaking the circuit to the power source.

12 Claims, 4 Drawing Sheets

ELECTRIC SWITCH WITH DYNAMIC BRAKE CONTACT SHARED FOR MAKING AND BREAKING A POWER CIRCUIT

BACKGROUND OF THE INVENTION

This invention relates to electric switches of the type including a dynamic braking circuit wherein the motor controlled by the switch is connected in a closed loop circuit upon opening a power circuit by the switch. More particularly, the invention relates to an electric switch of the aforementioned type which has a trigger operator for particular application in the handles of portable electric tools and the like.

A common practice for incorporating a dynamic braking circuit with an electric switch is to utilize a two-pole electric switch, using one pole for connection between the power source and load and the other pole for connection in the dynamic braking circuit. However, such embodiments place all of the arcing and erosion associated with the making and breaking of a power circuit on the contacts of one pole, while the contacts of the other pole remain relatively clean and unaffected because they only function to close or open a dynamic braking circuit to the motor, and therefore do not open or close on a significant current. Accordingly, switch life of the aforedescribed switch is substantially dependent upon the condition of the contacts of the pole utilized for making and breaking the power circuit.

SUMMARY OF THE INVENTION

This invention provides a two-pole electric switch having a normally closed pole of the switch connected in a loop with the motor to provide dynamic braking and a normally open pole connected in circuit with the power source to selectively connect or disconnect the motor load to the power source, wherein an additional movable contact conductively connected to the normally open movable bridging contact of the normally open pole, is arranged in normally open relationship with one stationary contact of the normally closed pole to provide an additional contact for sharing the circuit making and breaking load with the contacts of the normally open pole upon operation of the switch between open and closed conditions. That stationary contact of the normally closed pole which is engaged by the additional normally open movable contact is electrically jumpered to the load terminal of the normally open pole to connect the additional movable contact and that stationary contact in parallel with the contacts of the normally open pole. The invention reduces erosion of the contacts from switch operation and increases the operating life of the switch.

The invention, its features and advantages will become more readily apparent when reading the following description and claims in conjunction with the appended drawings.

DETAILED DESCRIPTION OF THE PREFERRED EMBODIMENT

Figure 1:
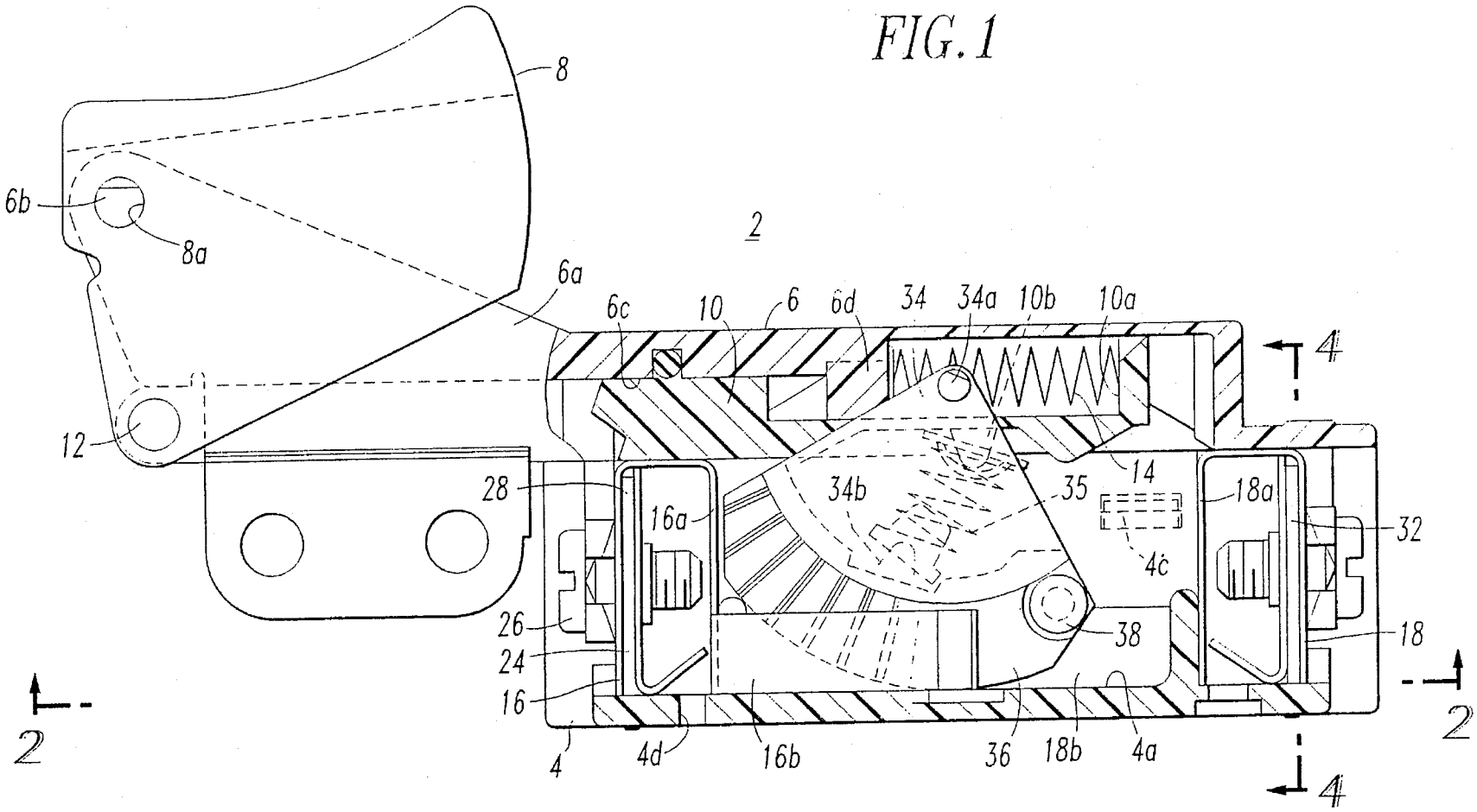
FIG. 1 is a longitudinal cross sectional view of the electric switch of this invention taken generally along the line 1—1 in FIG. 2 showing the switch in an OFF position.

The invention is illustrated in an embodiment of a double-pole single-throw electric tool handle switch of well known construction, but is equally useful and applicable in other types of switches such as rocker switches, toggle switches, slide switches and the like. Switch 2 comprises a molded insulating base 4 having a pair of longitudinally extending cavities 4*a* and 4*b* open to the upper side of the base as oriented in FIG. 1. A molded insulating cover 6 is attached over the open upper side of base 4 by a plurality of windows in resilient depending side walls of cover 6 which snap over a corresponding plurality of laterally extending projections 4*c* on the exterior of sidewalls of base 4. Only one of the projections 4*c* and corresponding windows are shown in dotted line in FIG. 1. Cover 6 further comprises a superstructure 6*a* which provides a pivot for a trigger operator 8, also molded of insulating material. Superstructure 6*a* is preferably provided with a pair of oppositely directed laterally extending trunions 6*b* (only one shown, FIG. 1 ) over which holes 8*a* in the side walls of trigger 8 are disposed to provide a snap-on attachment of the trigger 8 to the superstructure 6*a*. The cover and superstructure also provide a guide channel 6*c* for a switch actuator stem 10 which is pivotally attached to the trigger 8 by a rivet 12 which extends through the actuator stem and the side walls of the trigger. Rivet 12 is remotely located from pivot 6*b* such that clockwise pivotal movement of trigger 8 around 6*b* effects leftward linear motion of actuator stem 10 as viewed in FIG. 1. The end of actuator stem 10 within the switch housing comprising base 4 and cover 6 comprises a recess 10*a* in which a helical compression spring 14 is disposed. Spring 14 bears between a depending projection 6*d* on the interior of cover 6 and the right-hand end of recess 10*a* to bias the actuator stem 10 rightward as viewed in FIG. 1, thereby providing a counter-clockwise bias to trigger 8.

Base 4 is provided with four identical stationary contacts 16, 18, 20 and 22 arranged in oppositely disposed cooperating pairs in each of the cavities 4*a* and 4*b*. As viewed in FIG. 1, the stationary contacts 16, 18, 20, 22 each comprise an inverted U-shaped terminal end 16*a*, 18*a*, 20*a*, 22*a* which is positioned in a respective pocket provided at the opposite ends of each of the cavities 4*a* and 4*b*. The inner leg of the inverted U-shaped terminal end has a contact arm 16*b*, 18*b*, 20*b*, 22*b* extending to the center of the respective cavity. The respective opposed pairs of stationary contacts 16, 18 and 20, 22 are reversely arranged such that the distal ends of the contact arms 16*b*, 18*b*, and 20*b*, 22*b* are generally longitudinally overlapping, but laterally spaced apart (FIG. 2). A generally flat rectangular terminal plate 24 is disposed against the inside surface of the outer leg of each inverted U-shaped portion of the stationary contacts 16 and 20. Terminal plate 24 is provided with an extruded tapped hole to receive a terminal screw such as 26 which extends through a correspondingly aligned hole in the outer leg of the respective stationary contact. A generally U-shaped wire retention clip 28 is disposed against the terminal plate 24, the distal ends of the legs of clip 28 abutting the inner leg of U-shaped terminal portion 16*a* and 20*a* to resiliently grip and retain a wire inserted through appropriate holes 4*d* in the base 4 to provide for push-in terminations as well as screw terminations.

Figure 5:
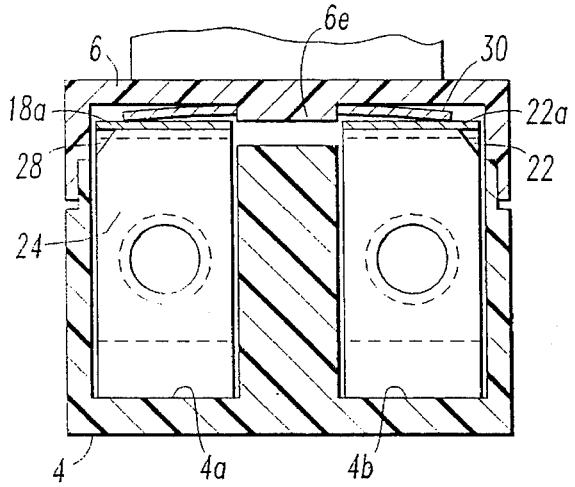
FIG. 5 is a view similar to FIG. 4 but showing an alternate embodiment of an electrical jumper for the load-end terminals of the switch.

The stationary contacts 18 and 22 of double-pole single throw switch 2 are interconnected to be electrically common in dynamic braking applications of the switch. One method of such interconnection is shown in FIG. 5 wherein a terminal plate 24 and wire retention clip 28 are placed in cavity 4*a* within the inverted U-shaped terminal portion 18*a* of stationary contact 18. Although not shown in FIG. 5, a terminal screw 26 is threadably engaged in the extruded tapped hole of terminal plate 24. No terminal plate or wire retention clip are provided for stationary contact 22. Cover 6 has a rectangular boss 6*e* depending from the top wall thereof to which an electrical bus 30 is attached by a press fit, heat staking or other suitable method. Bus 30 is made from good electrically conductive spring material and has a preformed downward bow at the outer ends to conductively engage the top surfaces of inverted U-shaped terminal portions 18*a* and 22*a* of stationary contacts 18 and 22, respectively. Attachment of cover 6 to base 4 compresses the bus 30 against stationary contacts 18 and 22 to establish a good electrical connection.

Figure 4:
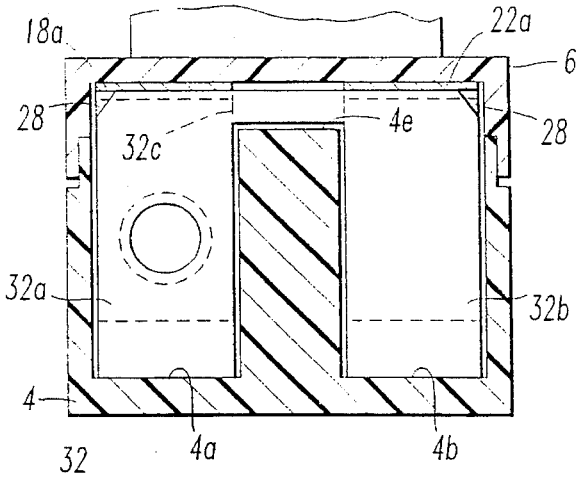
FIG. 4 is a transverse cross sectional view taken substantially along the line 4—4 in FIG. 1 showing an electrical jumper connecting load-end terminals of the switch together.

Another method of interconnecting stationary contacts 18 and 22 is particularly shown in FIG. 4. A double terminal plate 32 having lateral portions 32*a* and 32*b* joined along their upper edges by a bridge portion 32*c* is disposed within the U-shaped terminal portions 18*a* and 22*a* of stationary contacts 18 and 22. Lateral portion 32*a* is disposed in cavity 4*a* adjacent stationary contact 18. A wire retention clip 28 is also disposed in the stationary contact 18. Lateral portion 32*a* has a tapped extruded hole for receiving a terminal screw 26. Lateral portion 32*b* has no tapped hole for a terminal screw, but does have a wire retention clip 28 associated therewith to maintain good connection between terminal plate lateral portion 32*b* and stationary contact 22. A groove 4*e* is provided in the upper central wall of base 4 between cavities 4*a* and 4*b* for receiving bridging portion 32*c*. Although not specifically shown, it is further contemplated to affix stationary contact 22 directly to terminal plate lateral portion 32*b* such as by welding and to eliminate the wire retention clip 28 associated with stationary contact 22.

Figure 2:
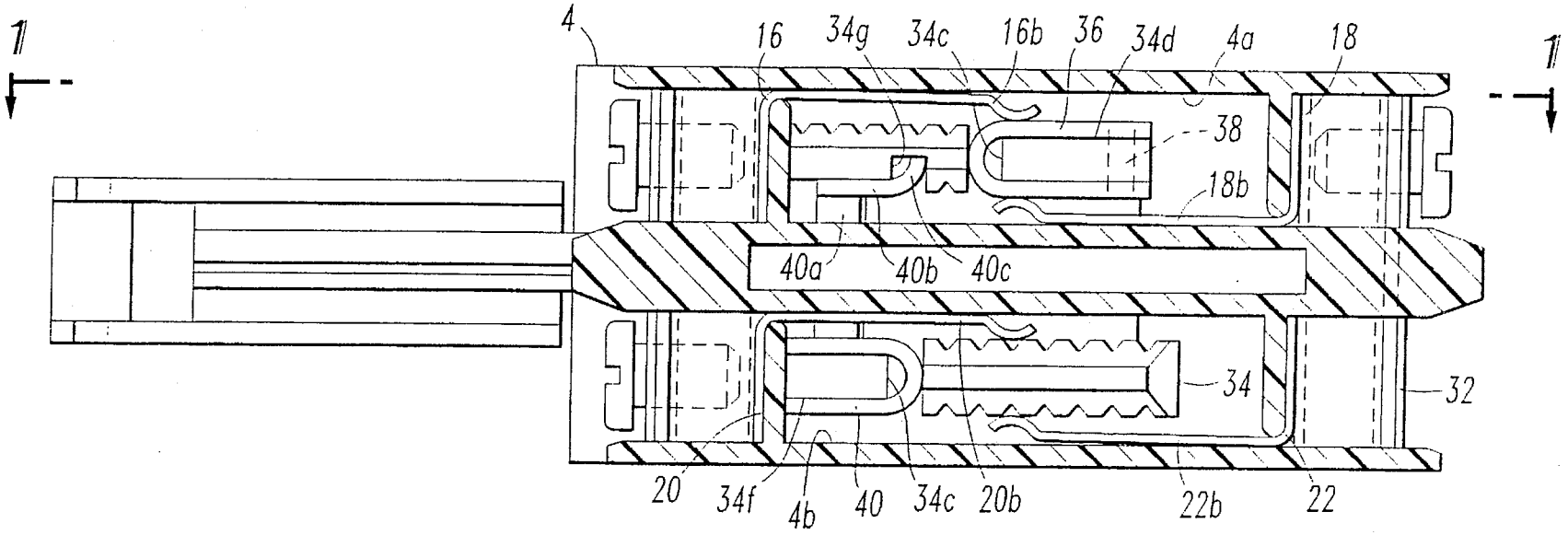
FIG. 2 is a cross sectional view taken generally along the line 2—2 in FIG. 1 viewing the switch contact structure from the bottom (as oriented in FIG. 1 ) of the switch showing the switch in an OFF position.
Figure 3:
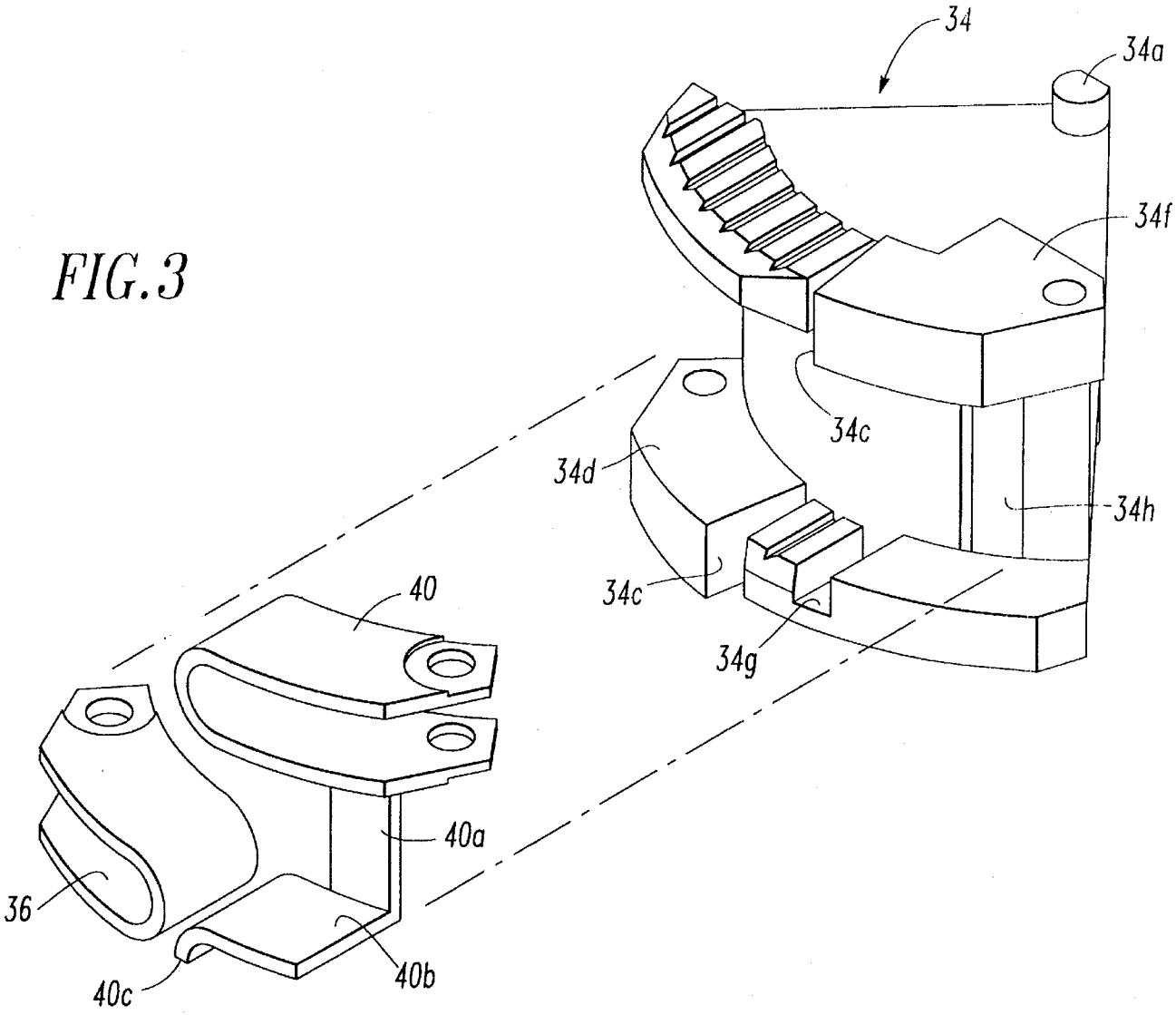
FIG. 3 is an exploded isometric view of the movable contact carrier and movable contacts constructed in accordance with this invention.

A U-shaped movable contact carrier 34 is pivotally mounted by trunnions 34*a* within appropriate openings (not shown) in cover 6. An overcenter compression spring assembly 35 is mounted between a depending boss 10*b* on actuator stem 10 and an upstanding boss 34*b* on movable contact carrier 34 to provide a snap action overcenter driving connection between actuator stem 10 and movable contact carrier 34. The legs of U-shaped movable contact carrier 34 depend into each of the cavities 4*a* and 4*b*. One end of the leg disposed in cavity 4*a* is radially serrated on the outer surface (see FIG. 2) and has a single serration (not numbered) on its inner surface. A slot 34*c* separates the serrated portion from a contact mounting surface 34*d* on which a U-shaped movable contact 36 is mounted with the closed end of the U of the movable contact 36 in the slot 34*c* and directed toward the serrated portion. A rivet 38 is provided to secure the movable contact 36 to the contact carrier 34. The leg of the contact carrier that extends into cavity 4*b* has the serrated portion located opposite that on the first leg and has a plurality of serrations along both the inner and outer surfaces. A slot 34*e* separates the serrated portion from contact mounting surface 34*f*. The corresponding U-shaped movable contact 40 (seen best in FIG. 3 ) is reversely disposed relative to the first movable contact 36. Movable contact has a transversely projecting arm 40*a* extending from one leg thereof. The distal end of arm 40*a* has a contact portion 40*b* extending generally parallel with the legs of U-shaped movable contact 40. One edge 40*c* of contact portion 40*b* is curved downward, whereby contact portion 40*b* has the configuration of one-half a U-shaped contact such as 36 or 40. A slot 34*g* is provided in the inner surface of one contact carrier leg adjacent the single serration to receive the downwardly curved edge 40*c* of contact portion 40*b*. A groove 34*h* is provided in the underside of contact carrier 34 between the legs thereof to receive arm 40*a* of movable contact 40.

Figure 6:
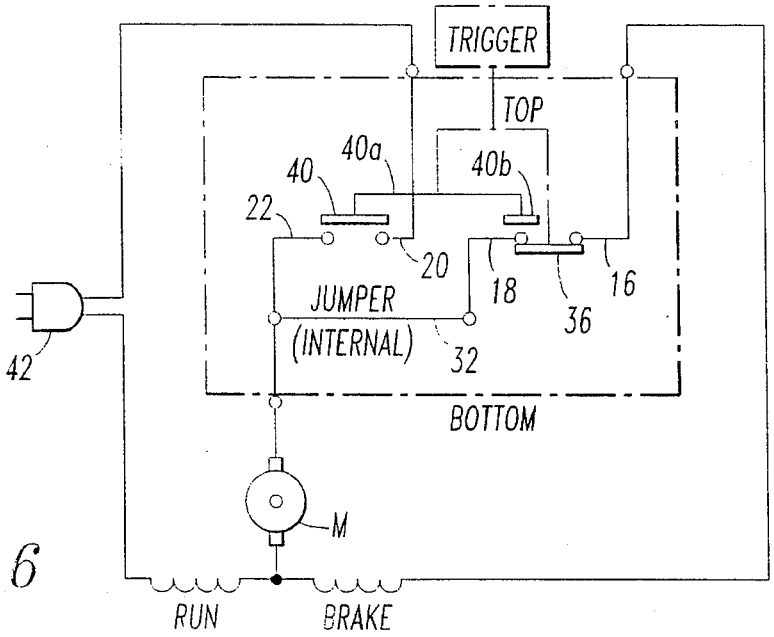
FIG. 6 is a schematic diagram of the switch of this invention.

With the contact carrier 34 installed as shown in FIG. 1, the overcenter drive connection 35 causes the carrier to assume a left-hand position within the base 4. In that position, movable contact 36 bridges the contact arms 16*b* and 18*b* of the respective stationary contacts 16 and 18 to complete a dynamic braking circuit for the motor M when properly wired as shown in FIG. 6. Depression of trigger 8 pulls actuator stem 10 to the left as viewed in FIG. 1, moving boss 10*b* overcenter of the drive connection 35 to effect rotation of movable contact carrier 34 to the right-hand position whereupon the dynamic braking circuit is interrupted by movement of movable contact 36 out from between contact arms 16*b* and 18*b*. In the right-hand position of contact carrier 34, movable contact 40 moves into bridging engagement between stationary contact arms 20*b* and 22*b* and contact portion 40*b* moves into engagement with stationary contact arm 18*b*, completing a parallel circuit between contacts 40*b* and 18*b* with that circuit between contacts 20*b* and 22*b* through contact 40. Thus load current from the source 42 (FIG. 6) to the load M is shared through the primary path of contacts 20, 22 and through the additional path of contacts 20–40*b*–18 to reduce the amount of current carried by contacts 20, 22. Reduction in current at the contacts reduces arcing and erosion of the contacts to increase the life of the switch. Although a preferred embodiment of this invention has been disclosed, it is to be understood tat this invention is susceptible of various modifications without departing from the scope of the claims.

I claim:

1. In a double pole single throw electric switch comprising normally open contact means comprising a first pole and normally closed contact means comprising a second pole, each said contact means comprising a pair of spaced stationary contacts and a movable bridging contact, the improvement comprising:

another movable contact disposed in normally open relation to one stationary contact of said pair of stationary contacts of said second pole; and means conductively connecting said another movable contact to said bridging contact of said first pole.

2. The double pole single throw electric switch defined in claim 1 further comprising means conductively connecting said one stationary contact to one of said pair of stationary contacts of said first pole.

3. The double pole single throw electric switch defined in claim 2 wherein said another movable contact is arranged to close on said one stationary contact of said second pole substantially simultaneously with said bridging contact of said first pole closing on said pair of stationary contacts of said first pole.

4. The double pole single throw electric switch defined in claim 3 wherein said normally closed contact means are arranged to open before said normally open bridging contact of said first pole and said another movable contact of said second pole close on respective said stationary contacts.

5. A double pole single throw electric switch comprising:

an insulating housing;

first and second stationary contacts mounted in spaced apart relation in said housing;

third and fourth stationary contacts mounted in spaced apart relation in said housing;

contact carrier mounted in said housing for reciprocal movement between first and second positions;

actuating means mounted in said housing and being connected to said contact carrier for effecting movement of said contact carrier between said first and second positions;

first, second and third movable contacts mounted on said contact carrier;

said first movable contact being disposed in normally open relation to said first and second stationary contacts in said first position of said contact carrier and bridging said first and second stationary contacts in said second position of said contact carrier;

said second movable contact being disposed in normally closed bridging relation with said third and fourth stationary contacts in said first position of said contact carrier and separated from said third and fourth stationary contacts in said second position of said contact carrier;

said third movable contact being disposed in normally open relation to said third stationary contact in said first position of said contact carrier and engaging said third stationary contact in said second position of said contact carrier; and means conductively interconnecting said first and third movable contacts.

6. The double pole single throw electric switch defined in claim 5 further comprising conductive means interconnecting said first and said third stationary contacts.

7. The double pole single throw electric switch defined in claim 7 wherein said conductive means interconnecting said first and said third stationary contacts comprises a conductive member disposed within said housing.

8. The double pole single throw electric switch defined in claim 5 further comprising means biasing said actuating means to effect movement of said contact carrier to said first position.

9. A double pole single throw electric switch comprising:

an insulating housing comprising a base having a cavity open to one side of said base and a cover secured to said base over said open side, first and second stationary contacts mounted in said housing and disposed in spaced apart relation in said cavity;

third and fourth stationary contacts mounted in said housing and disposed in spaced apart relation in said cavity;

an insulating contact carrier mounted in said cavity for reciprocal movement between first and second positions;

actuating means mounted to said cover and connected to said contact carrier for effecting movement of said contact carrier between said first and second positions;

first, second and third movable contacts mounted on said contact carrier;

said first movable contact being disposed in normally open relation to said first and second stationary contacts in said first position of said contact carrier and bridging said first and second stationary contacts in said second position of said contact carrier;

said second movable contact being disposed in normally closed bridging relation with said third and fourth stationary contacts in said first position of said contact carrier and separated from said third and fourth stationary contacts in said second position of said contact carrier;

said third movable contact being disposed in normally open relation to said third stationary contact in said first position of said contact carrier and engaging said third stationary contact in said second position of said contact carrier; and conductive means interconnecting said first and third movable contacts.

10. The double pole single throw electric switch defined in claim 9 further comprising conductive means interconnecting said first and said third stationary contacts.

11. The double pole single throw electric switch defined in claim 10 wherein said conductive means interconnecting said first and said third stationary contacts comprises a conductive member disposed in said base.

12. The double pole single throw electric switch defined in claim 9 further comprising means biasing said actuating means to effect movement of said contact carrier to said first position.

* * * * *